United States Patent [19]

Ross

[11] 4,095,042

[45] June 13, 1978

[54] WOVEN SHIELDED CABLE

[75] Inventor: Edgar A. Ross, Greenville, S.C.

[73] Assignee: Southern Weaving Company, Greenville, S.C.

[21] Appl. No.: 720,964

[22] Filed: Sep. 7, 1976

[51] Int. Cl.[2] ..... H01B 7/08

[52] U.S. Cl. ..... 174/36; 174/72 TR; 174/117 F

[58] Field of Search ..... 174/27, 36, 72 TR, 117 R, 174/117 F, 117 FF, 117 M, 113 R; 139/425 R

[56] References Cited

U.S. PATENT DOCUMENTS

| | | | |
|---|---|---|---|
| 2,433,346 | 11/1947 | Deakin | 174/117 F X |
| 3,476,870 | 11/1969 | Ross | 174/117 M X |
| 3,495,025 | 2/1970 | Ross | 174/72 TR X |
| 3,654,380 | 4/1972 | Tatum et al. | 174/117 F X |
| 3,654,381 | 4/1972 | Copp | 174/117 F |
| 3,775,552 | 11/1973 | Schumacher | 174/36 X |

FOREIGN PATENT DOCUMENTS

| | | | |
|---|---|---|---|
| 356,899 | 9/1931 | United Kingdom | 174/36 |
| 1,380,775 | 1/1975 | United Kingdom | 174/117 R |

OTHER PUBLICATIONS

Schuh, A. G. Flat Flexible Cable and Wiring Types, Materials, Constructions, and Features, Insulation/Circuits, 10–70 pp. 27–34.

Woven Electronics, Southern Weaving Co., 1972.

*Primary Examiner*—Arthur T. Grimley

*Attorney, Agent, or Firm*—Bailey, Dority & Flint

[57] ABSTRACT

A shielded cable is disclosed in which a plurality of elongated conductor wires are interwoven with a plurality of metallic fiber strands to define a woven cover for isolating the conductor wires from electromagnetic interference. The woven cover includes a plurality of fiber warp strands woven with a continuous fiber fill strand defining a plain weave of metallic fibers around the conductor wires to shield from external interference and a plurality of warp binder strands woven between adjacent conductor wires between alternate top and bottom runs of the fill strand to shield the conductor wires from internal interference.

8 Claims, 4 Drawing Figures

WOVEN SHIELDED CABLE

BACKGROUND OF THE INVENTION

This invention relates generally to electrical conductor cables formed of a plurality of conductor wires and more particularly to woven cables having a plurality of elongated conductor wires arranged in a side-by-side manner and interwoven with fiber strands to provide a substantially flat configuration. In electrical applications it is frequently desirable to shield a conductor against external electromagnetic interferences such as magnetic or RFI interference. Both circular and flat cables have certain advantages which are most readily appreciated by considering their electrical applications. While flat cables have constant conductor locations and can be easily connected to devices by using automatic stripping and cutting, shielding of the conductor wires in the flat cable configuration has been more difficult than the circular cable and is usually limited to shielding individual conductors in the cable. Circular cables are more easily shielded from external interferences such as by enclosing the wires in a lead sheaf or surrounding the wires with a metallic foil tape.

SUMMARY OF THE INVENTION

A shielded cable is constructed comprising a plurality of elongated conductor wires, and a plurality of metallic fiber strands interwoven with the conductor wires to define a woven cover for isolating the conductor wires from electromagnetic interference. The woven cover further includes a plurality of fiber warp strands and a continuous fiber fill strand woven to define a plain weave of the metallic fibers around the conductor wires to shield the wires from external interference. A plurality of warp binder strands are woven between adjacent conductor wires having undulations woven between alternate top and bottom runs of the fill strand approximately one hundred eighty degrees out of phase with adjacent warp binder strands mutually isolating the conductor wires. Thus, the conductor wires are effectively shielded from external and internal interference.

Accordingly, an important object of the present invention is to provide a flat woven electrical cable wherein the conductor wires are effectively shielded from external and internal interferences.

Another important object of the present invention is to provide a shielded cable wherein elongated conductor wires are interwoven with metallic fiber strands to define a metallic woven cover effectively shielding the cable from electromagnetic interferences.

Still another important object of the present invention is to provide a woven shielded cable having a substantially flat configuration and having all the advantages of a flat cable as well as the favorable shielding characteristics of a circular cable.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
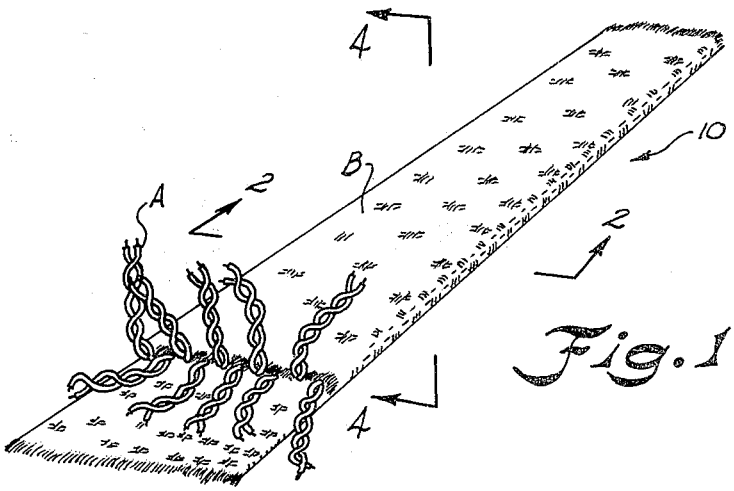
FIG. 1 is a perspective view of a woven shielded cable constructed in accordance with the present invention.
Figure 2:
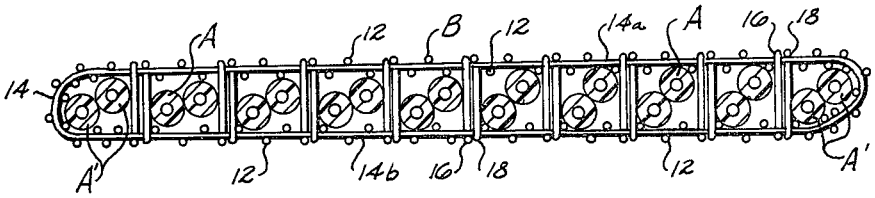
FIG. 2 is a sectional view taken along the line 2—2 of FIG. 1.
Figure 3:
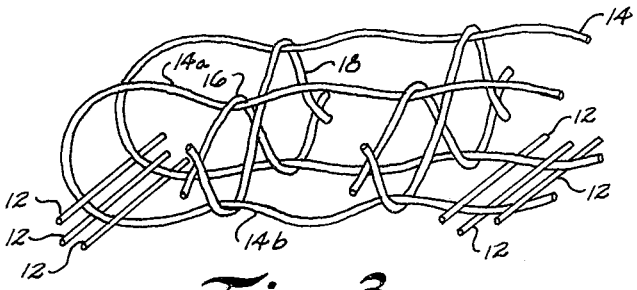
FIG. 3 is a perspective view illustrating a woven cover for shielding conductor wires in accordance with the present invention wherein the conductor wires are omitted for clarity.
Figure 4:
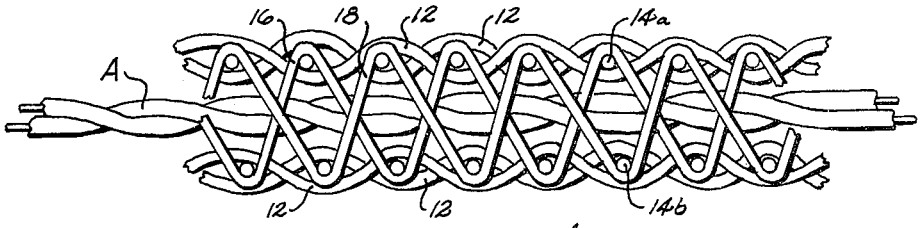
FIG. 4 is a sectional view taken along the line 4—4 of FIG. 1.

The drawing illustrates a woven cable designated generally at 10 having a plurality of elongated conductor wires A for transmitting electrical power or signals. The woven cable has a substantially flat configuration which makes it highly flexible in making installation and routing to the proper electrical terminals.

A woven cover B formed from metallic fiber strands is woven about the conductor wires A isolating the wires from interferences such as lightning, electromagnetic, and radio frequency interference. The woven cover B includes a plurality of fiber warp strands 12 extending in a substantially parallel manner with the conductor wires A and interwoven with a continuous metallic fill strand 14 in a plain weave pattern to form a substantially solid outer cover surrounding the conductor wires A for shielding and isolating the conductor wires from external interference. The woven cover B further includes a pair of warp binder strands 16 and 18 woven between adjacent conductor wires in an undulating pattern between the alternate top and bottom runs **14*a* and 14*b*, respectively, of the fill strand 14. The undulations of adjacent warp binder strands 16 and 18** are approximately one hundred eighty degrees out of phase providing an effective shield between adjacent conductor wires for isolation against internal interferences.

In the preferred embodiment, the warp binder strands 16 and 18 are woven with the fill strands 14 to separate the conductors A into conductor wire pairs A′ which are normally twisted together. The conductor wire pairs A′ thus formed are effectively shielded from external interference by the outer plain weave portion of the woven cover B and are shielded from internal interferences between adjacent conductor wire pairs by the warp binder strands 16 and 18. It is to be understood, of course, that a different number of warp binder strands may be utilized depending upon the desired amount of shielding needed between conductor wires for isolation from interference. The warp binder strands 16 and 18 so formed provide a criss-cross wall pattern between adjacent conductor wires or conductor wire pairs.

In the preferred embodiment the metallic fiber strands which include warp strands 12, warp binder strands 16 and 18 and fill strand 14 are preferably a silver plated nylon. If desired, an outer cover of polymide or polyester may be woven about the metallic fiber cover for additional protection and preservation of the silver plated nylon fibers.

Thus, it can be seen that an effective metallic shield can be constructed using metallic fiber strands interwoven about a plurality of conductor wires for effectively shielding and isolating the conductor wires from external as well as internal interference. By providing a woven cover of a metallic fiber in accordance with the present invention, a woven cable having a substantially flat configuration can be had eliminating the need for twisting the cable and enclosing the cable in foil or in a metal sheaf which has typically been a necessity for flat woven cables. It is also contemplated that the woven metallic shield of the present invention may also have advantageous application to cables having other configurations.

While a preferred embodiment of the invention has been described using specific terms, such description is for illustrative purposes only, and it is to be understood that changes and variations may be made without departing from the spirit or scope of the following claims.

What is claimed is:

1. A woven shielded cable comprising:

a plurality of elongated conductor wires extending longitudinally in said cable each said wire having a coating of insulation;

a substantially solid outer woven cover formed from metallic fiber strands woven about said conductor wires isolating said wires from external electromagnetic interference;

said woven cover including at least one metallic warp binder strand woven between adjacent conductor wires to separate and shield at least one of said conductor wires between adjacent warp binder strands for reducing internal interference between conductor wires; and a metallic fill strand woven about said conductor wires and said warp binder strand;

whereby said conductor wires are uniformly shielded from external and internal interference.

2. The shielded cable as set forth in claim 1 wherein said conductor wires are arranged in a generally side-by-side manner to define a substantially flat cable configuration and wherein said woven cover includes a plurality of metallic fiber warp strands woven in a plain weave with said fill strand to form a substantially solid outer cover surrounding said wires for shielding and isolating said conductor wires.

3. The shielded cable as set forth in claim 2 wherein a plurality of said warp binder strands are woven between adjacent conductor wires in an undulating manner between alternate top and bottom runs of said fill strand enhancing uniform shielding of said conductor wires.

4. The shielded cable as set forth in claim 1 wherein said metallic fiber comprises silver plated nylon.

5. The shielded cable as set forth in claim 1 wherein a plurality of said warp binder strands are woven between adjacent conductor wires in an undulating pattern between alternate top and bottom runs of said fill strand with the undulations of adjacent warp binder strands approximately one-hundred and eighty degrees out of phase enhancing the internal shielding of said conductor wires.

6. The shielded cable as set forth in claim 1 wherein said warp binder strand is woven with said fill strand to separate and shield said conductor wires in groups of at least two conductor wires.

7. The shielded cable as set forth in claim 6 wherein a plurality of said warp binder strands are woven between adjacent conductor wire pairs in an undulating pattern between alternate top and bottom runs of said fill strand enhancing shielding of said conductor wires.

8. A woven shielded cable comprising:

a plurality of elongated conductor wires extending longitudinally in said cable each said wire having a coating of insulation;

a plurality of metallic fiber strands interwoven with said conductor wires to define a woven cover for isolating said conductor wires from electromagnetic interference;

said woven cover including a plurality of fiber warp strands and a continuous fiber fill strand woven defining a plain weave of said metallic fibers around said conductor wires to shield said wires from external interference; and at least a pair of warp binder strands woven between adjacent conductor wires to separate and shield at least one of said conductor wires between adjacent pairs of said warp binder strands; and said warp binder strands in each said pair being woven in an undulating pattern between alternate top and bottom runs of said fill strand approximately one-hundred and eighty degrees out of phase relative to each other reducing internal interference in said cable;

whereby said conductor wires are effectively shielded from external and internal interference.

* * * * *